United States Patent [19]

Jörgensen

[11] Patent Number: 4,509,326

[45] Date of Patent: Apr. 9, 1985

[54] ENERGY EXTRACTION FROM HOT GASES

[75] Inventor: Pierre Jörgensen, L'Hay les Roses, France

[73] Assignee: The British Petroleum Company p.l.c., London, England

[21] Appl. No.: 404,360

[22] Filed: Aug. 2, 1982

[30] Foreign Application Priority Data

Aug. 7, 1981 [FR] France ..... 81 15370

[51] Int. Cl.[3] ..... F01K 23/00

[52] U.S. Cl. ..... 60/39.182; 60/648

[58] Field of Search ..... 60/39.182, 648, 655

[56] References Cited

U.S. PATENT DOCUMENTS

| | | | |
|---|---|---|---|
| 3,234,735 | 2/1966 | Pirsh | 60/39.182 |
| 3,731,495 | 5/1973 | Coveney | 60/39.182 |
| 3,986,348 | 10/1976 | Switzer | 60/39.02 |
| 3,991,557 | 11/1976 | Donath | 60/39.182 |
| 4,069,660 | 1/1978 | Inubushi et al. | 60/39.02 X |
| 4,074,981 | 2/1978 | Slater | 48/197 |
| 4,261,167 | 4/1981 | Paull et al. | 60/39.182 X |

FOREIGN PATENT DOCUMENTS

| | | |
|---|---|---|
| 0013580 | 7/1980 | European Pat. Off. . |
| 2948389 | 11/1981 | Fed. Rep. of Germany . |
| 1363813 | 12/1964 | France . |
| 173497 | 11/1934 | Switzerland . |

OTHER PUBLICATIONS

Hydrocarbon Processing, vol. 57, No. 12, Dec. 1978, Houston, (US), T. A. Dziewulski et al., "Recover Power From FCC Units", pp. 131–135.

*Primary Examiner*—Allen M. Ostrager

*Attorney, Agent, or Firm*—Morgan, Finnegan, Pine Foley & Lee

[57] ABSTRACT

Energy is extracted from hot dust-laden gases by a process in which the hot gases, before being cooled or purified, are used to generate steam in a boiler. The solid particles are then removed from the gases which are then supplied to a turbine.

4 Claims, 9 Drawing Figures

ENERGY EXTRACTION FROM HOT GASES

This invention relates to a process for extracting energy and removing solid particles from hot, dust-laden gases.

Such gases are produced by blast furnaces, gas producers for the manufacture of producer gas or water gas, and fluidised bed cat-crackers for converting heavy oil fractions into lighter fractions.

One problem posed by such plant is to adjust the supply of air and the discharge of the hot effluent gases in accordance with the requirements of the reaction by recovering the maximum amount of energy so as to decrease operating costs or possibly to generate power, whilst at the same time maintaining the equipment in good condition.

According to conventional practice the mechanical energy contained in the hot gases under pressure is recovered first of all by a turbine. Such recovery would not involve any special difficulty if it were not for the presence of solid particles which causes severe erosion of the turbine. A solid particle removal device is therefore placed upstream of this turbine, but the solid particles, combined with the high temperature, cause large-scale erosion of the removal device. For this reason, the hot gases are initially cooled down to the limit permitted by the behaviour of the materials. Conventional procedure comprises cooling the gases down to a temperature of about 730° by injecting water.

Solid particles are then removed as completely as possible from the gases in a device working at its maximum temperature. The mechanical energy of expansion is then extracted by an expansion turbine before recovering the residual thermal energy in a boiler. The turbine drives the compressor which supplies the combustion air under pressure. The turbine is regulated by a bypass and throttle valve to ensure the desired pressure supplied by the compressor. A make-up turbine is coupled to the unit together with a generator motor, usually asynchronous, which regulates the speed of the unit.

The conventional solution has a number of drawbacks, one of which is the fact that it causes materials in the plant and machines to operate at a high temperature in conjunction with pressure stresses. This shortens the life of the equipment because of creep, despite the initial cooling which constitutes a considerable loss of energy. It is clear that these two defects are conflicting ones, and that any improvement in respect of one of them can only be attained at the expense of the other.

The object of the invention is to avoid both this loss of energy from initial cooling and large creep stresses on the plant, solid particle remover and turbine, when working dry.

It is a feature of the invention that the sequence of operations is inverted, that is to say the thermal energy is recovered first and the mechanical energy afterwards. For this purpose the dust-laden hot gases under pressure are passed into a boiler where heat is recovered, preferably in amount such that the gases are sufficiently lowered in temperature to leave the turbine, after expansion, at the minimum exit temperature, that is to say slightly above the maximum temperature of possible acid corrosion by gas or fumes.

The gases which are significantly cooled in this way, but are still under pressure, leave the boiler and pass into a particle removing device which, because of the lower temperature of the gases is less affected by creep. The cooling, moreover, permits easier and more effective removal of solid particles from the gases. These gases, still under pressure but comparatively cool, then supply an expansion turbine which is relatively unaffected by creep and which can employ a variable inlet adjustment, thus giving a better yield than control by bypass and throttle valve, and also variable speed. The compressor/turbine recovery unit in this case is always short of energy and consequently does not have an electric generator dependent on the system. A simple conventional steam turbine is added instead, regulated by the conventional practical methods, such as gradual lifting of the inlet valves, and which makes it possible to adjust the speed of the unit very simply. A drive employing a variable-speed electric motor may also be used in cases where this is feasible from an economic point of view.

The boiler which constitutes the main extractor of energy in the process according to the invention is designed as a conventional steam boiler in a pressure-resistant jacket, and dimensioned in such a way that the speed of flow of the dust-laden hot gases is neither too high, so that it produces erosion, nor too low, so that it produces deposits and clogging, and consequently has an optimum value experimentally determined but generally between 10 and 30 meters per second. The large quantity of steam produced by this boiler represents mechanical energy which can easily be utilised for all the auxiliary engines and for the recovery of energy in the form of electricity by means of conventional turbines.

The invention is illustrated with reference to FIGS. 1–9 of the accompanying drawings wherein.

Figure 1:
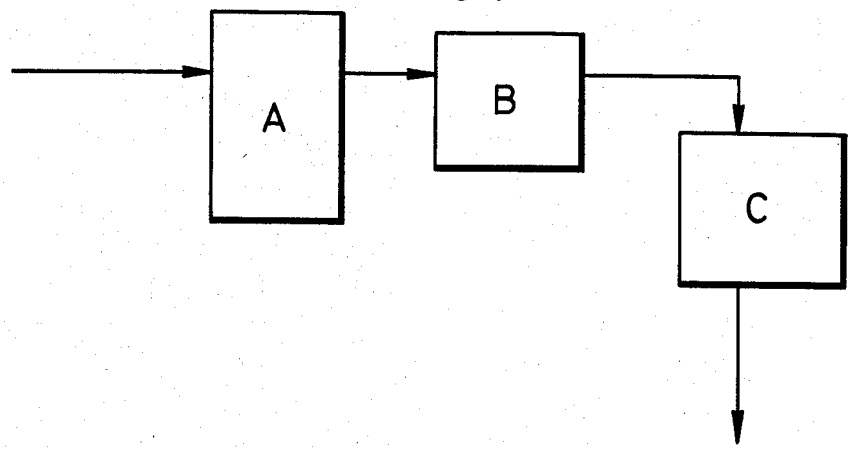
FIG. 1 represents a simplified diagram of the process.

With reference to FIG. 1, hot, dust-laden gas under pressure is supplied to a boiler A wherein thermal energy is recovered. The cooled gas, still under pressure, is then fed to a device B for removing solid particles. The cleaned gas is then passed to a turbine C wherein mechanical energy is recovered and from which it is exhausted for discharge to the atmosphere or for further use.

Figure 2:
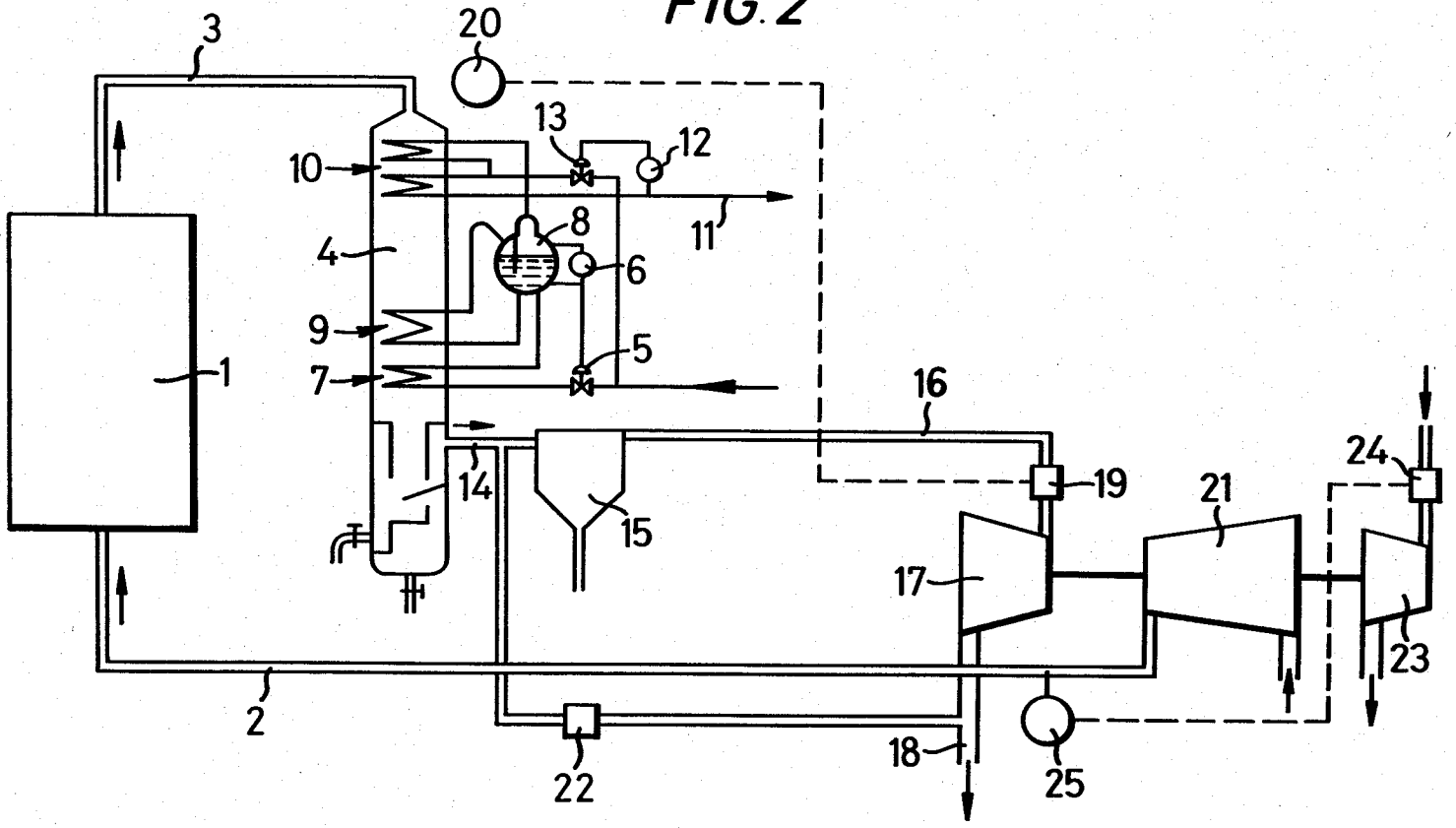
FIG. 2 is a more detailed diagram of a special application.

In FIG. 2, the main installation 1 represents a metallurgical, power or chemical plant which uses a gas reagent under pressure, ie compressed air, arriving at 2, and emits at 3 a hot dust-laden gaseous product also under pressure. This product may be the main product (producer gas) supplied by the plant 1 in the case of a gas producer, or a secondary product (blast furnace gas) in the case of a blast furnace, or simply a hot energy-containing effluent which has to be disposed of after extracting energy from it. This is the case when the plant 1 is the regenerator section associated with a fluidised bed catcracker reactor. The solid particles may be, depending on the source, ash, particles of coal or coke or catalyst. In practically all cases the plant 1 includes its own solid-particle device for extracting the largest particles which have escaped from the reaction, so that the hot effluent emerging at 3 is usually laden with comparatively fine dust, from 5 to 10 microns in size. Its temperature is generally of the order of 700° to 800° and the pressure is generally several atmospheres, varying according to the process.

The problem posed is therefore that of recovering the maximum amount of energy contained in the hot effluent gases under pressure, whilst at the same time preserving the equipment.

According to the invention the hot dust-laden effluent under pressure is supplied directly to a conventional steam boiler 4, for example, a vertical nest of tubes, enclosed in a pressure resistent jacket. In a conventional system, the water distributed by a valve 5 controlled by a level gauge 6 passes firstly into a heater 7 and then into a reservoir 8 whose level is controlled by the level gauge 6, whence it passes into an evaporator 9 which converts this water into steam, the latter returning to the reservoir 8 which allows only the wet vapour to escape to the superheater 10. Dry steam at high pressure emerges at 11. The superheat temperature of the steam is regulated by a thermostat 12 controlling a solenoid valve 13 for re-injection of water.

It is known that at low speeds, of less than 10 meters per second, the dust-laden gases tend to produce deposits and adhesions of solid particles which cause fouling of the boiler. On the other hand, at excessive speeds, above 30 meters per second, these dust-laden gases tend to erode the walls. According to the invention, the boiler 4 is therefore dimensioned in such a way that the flow speed of the hot dust-laden effluent at sensitive locations is between 10 and 30 meters per second, and preferably about 20 meters per second. This may, however, vary according to the chemical nature and particle size of the dust, and also according to the temperature of the gases. At the optimum speed there is practically no deposit or erosion.

In this boiler the gases are cooled from about 700°–800° to about 300° and leave via 14 at this temperature on their way to a solid particle removal device 15 of the single or multiple cyclone type. At this reduced temperature there is no creep stress, despite the pressure, and no major problem.

The gases leave at 16 at about 300° and, still under pressure although free from solid particles, and pass to the expansion turbine 17 to be evacuated cold at 18 or at least at the maximum evacuation temperature avoiding acid corrosion.

The expansion turbine 17, which operates at the reduced temperature of approximately 300°, can be regulated easily by a high-output variable inlet device 19. This device in turn is controlled from a pressure pick-up 20 located, for example at the inlet to the boiler 4 in such a way that the pressure in the plant 1 is at its nominal value. The expansion turbine 17 drives the compressor 21 which supplies the compressed air in the piping 2. A safety device 22 may also evacuate directly the gases leaving under pressure due to blocking of the solid particle removing device 15 or a boiler tube rupture.

Because most of the energy is extracted in the form of steam from the boiler 4, the amount of energy recovered in mechanical form by the expansion turbine 17 is relatively small, so that not only is there no need to fit an electric generator to the unit 17–21, thus permitting a variable speed for the unit, but it is even an advantage to manage the whole so that the unit is deficient in energy and to associate with it a small conventional make-up steam turbine 23, whose inlet 24 is controlled from a detector 25 measuring the air in 2.

The feed steam for the turbine 23 is taken from the principal steam supplied at 11, and the surplus, by far greater part, is available for use, either in the form of steam, or converted into electricity.

Figure 3:
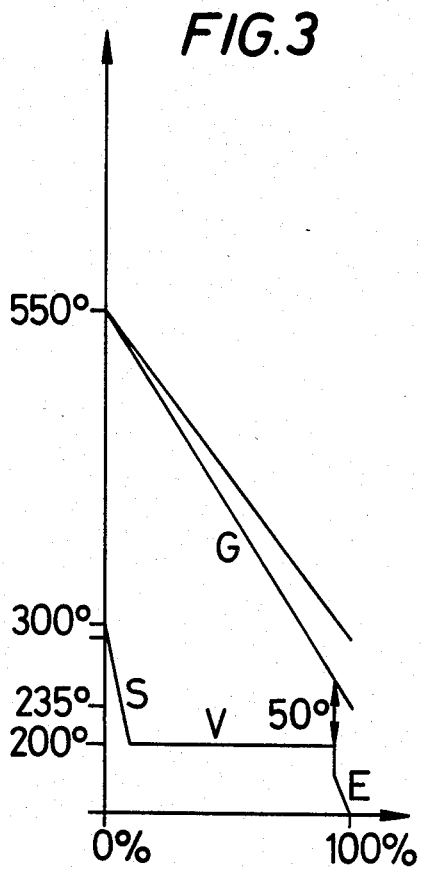
FIGS. 3 and 4 represent heat transfer curves in a conventional process and a process according to the invention, respectively.
Figure 4:
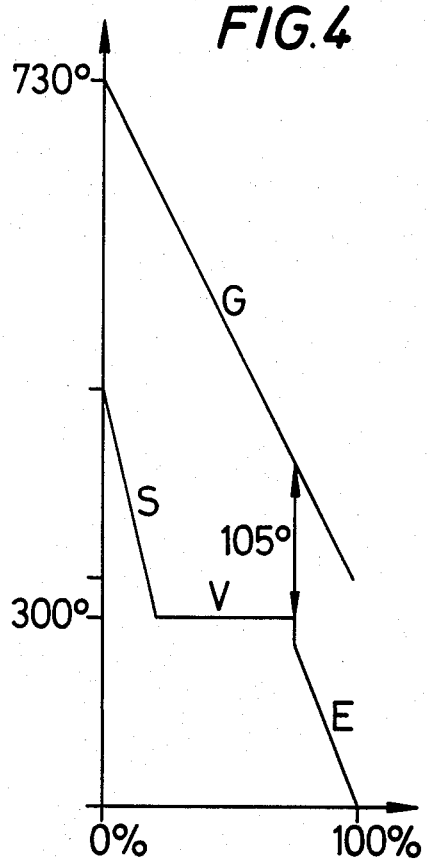

FIG. 3 is a graph of heat exchange in a conventional plant, showing the development of the temperatures S in the superheater, V in the evaporator and E in the economiser, and at G the development of the gas temperatures in two working hypotheses. It can be seen that even in the more favourable hypothesis, in the case of a back boiler it is very difficult to discharge the gases at below 235° C., which constitutes an appreciable loss of energy, with moreover a maximum temperature differential of 50° requiring a large exchange surface for the boiler. On the other hand, in the case according to the invention illustrated by FIG. 4, it can be seen that for the same scales and the same notations the maximum temperature differential is greater than 100°, and hence the transfer efficiency of the boiler is much superior. Subsequently the gases are discharged at 18 at a much lower temperature, and therefore with a much smaller loss of energy.

Figure 5:
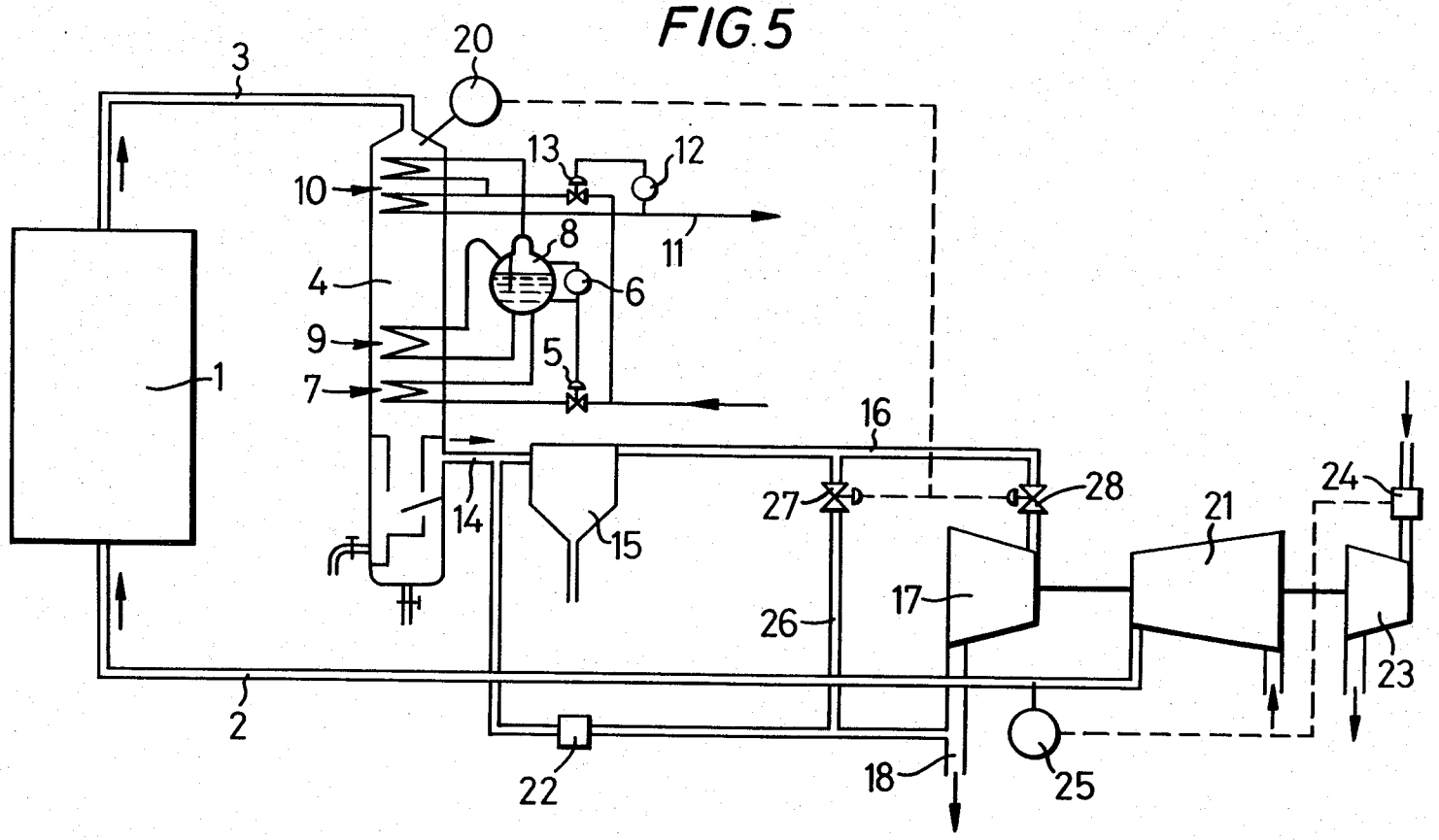
FIGS. 5 to 9 are diagrams of various embodiments.

FIG. 5 represents a variant similar to the preceding one in which the advantage of employing variable inlet regulation for the turbine 17 has been dispensed with, and the older arrangement required for high temperatures has been preserved, ie bypass 26 and two throttle valves 27 and 28 controlled by the pressure controller 20. In this case the overall efficiency of the plant is almost as great, since any reduction in yield affects the small fraction of energy converted by the expansion turbine 17, whilst the greater part of the energy continues to be extracted to a high degree by the boiler 4 and exploited in very efficient and high-powered turbines.

Figure 6:
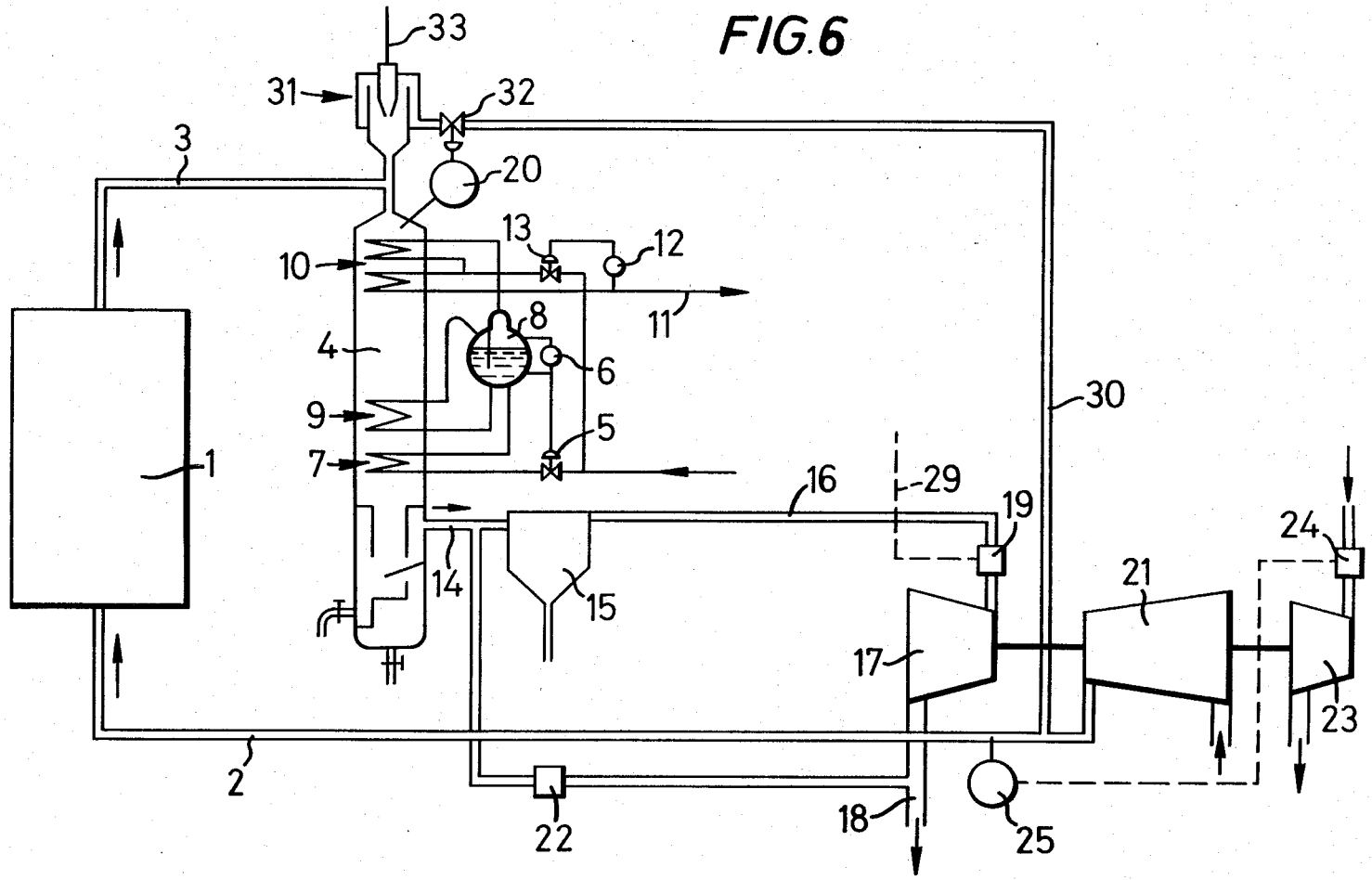

FIG. 6 illustrates another variant of FIG. 2 in which either maximum power is desired in the form of high-pressure steam, or a virtually constant speed is desired on the shafting of the turbine. In this case, in fact, the variable inlet 19 of the expansion turbine 17 is controlled by any regulating device acting at 29, either depending on the steam requirements in the first case, or by response from a transmission speed control in the second case. The compressor 21 can then operate at maximum speed to supply the plant 1, and the surplus output is branched via 30 to the boiler 4, after heating it by burning extra heating fuel in a burner 31. The air thus heated is mixed with the hot effluent coming from 3 to enter the boiler 4. As before, there is a pressure regulator 20 measuring the pressure at the inlet to the boiler 4, but this time it controls the air inlet valve 32 branched via 30 instead of controlling the inlet to the turbine 17. The expansion turbine is then loaded, with the inlet valves wide open, which avoids any bypass and throttling and maintains the output at a high level, taking into account the increased steam production despite the supplementary combustion of fuel fed in at 33.

Figure 7:
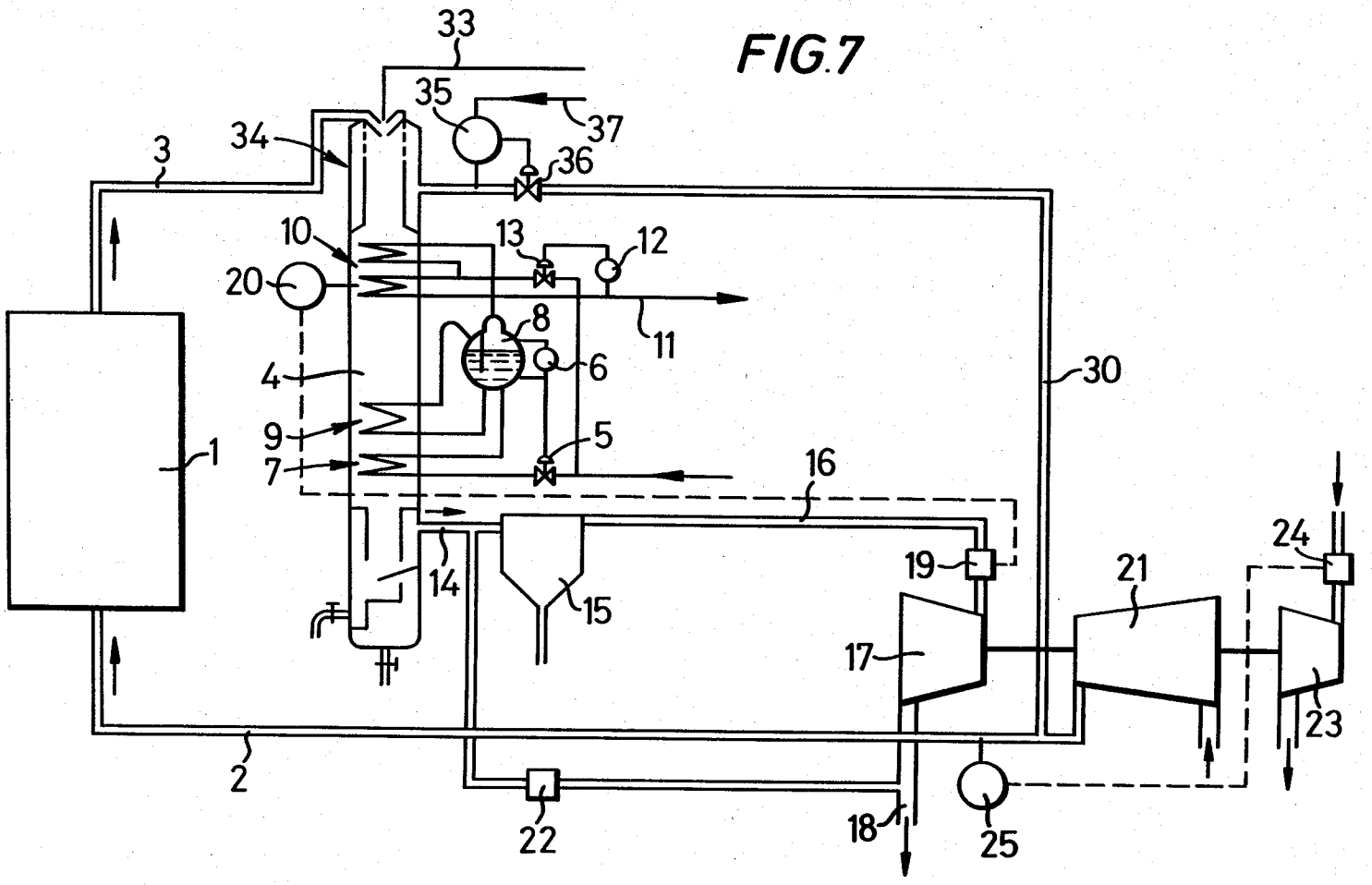

FIG. 7 is another variant for use when the effluent leaving at 3 contains carbon monoxide, for example in the case where the plant 1 is the regenerator of a fluidised bed catalytic cracker apparatus which is operated to burn the coke only partially in order to provide carbon monoxide and not carbon dioxide, which reduces all temperatures and prolongs the life of the catalyst. In this case, as in the preceding example, part of the air is branched via 30 and injected into an after burner 34 where the combustion of the carbon monoxide takes place, together with an injection 33 of priming or make-up fuel. A flow regulator 35 controls the flow of air arriving at 30 via a valve 36 depending on a signal received at 37 from a gas analysis probe which is adjusted to have a slight excess of air. The pressure regulator 20 acts directly on the inlet 19 of the turbine 17. This latter arrangement is particularly reliable and makes it possible to recover substantially all the energy both thermal and chemical, contained in the effluent 3.

Figure 8:
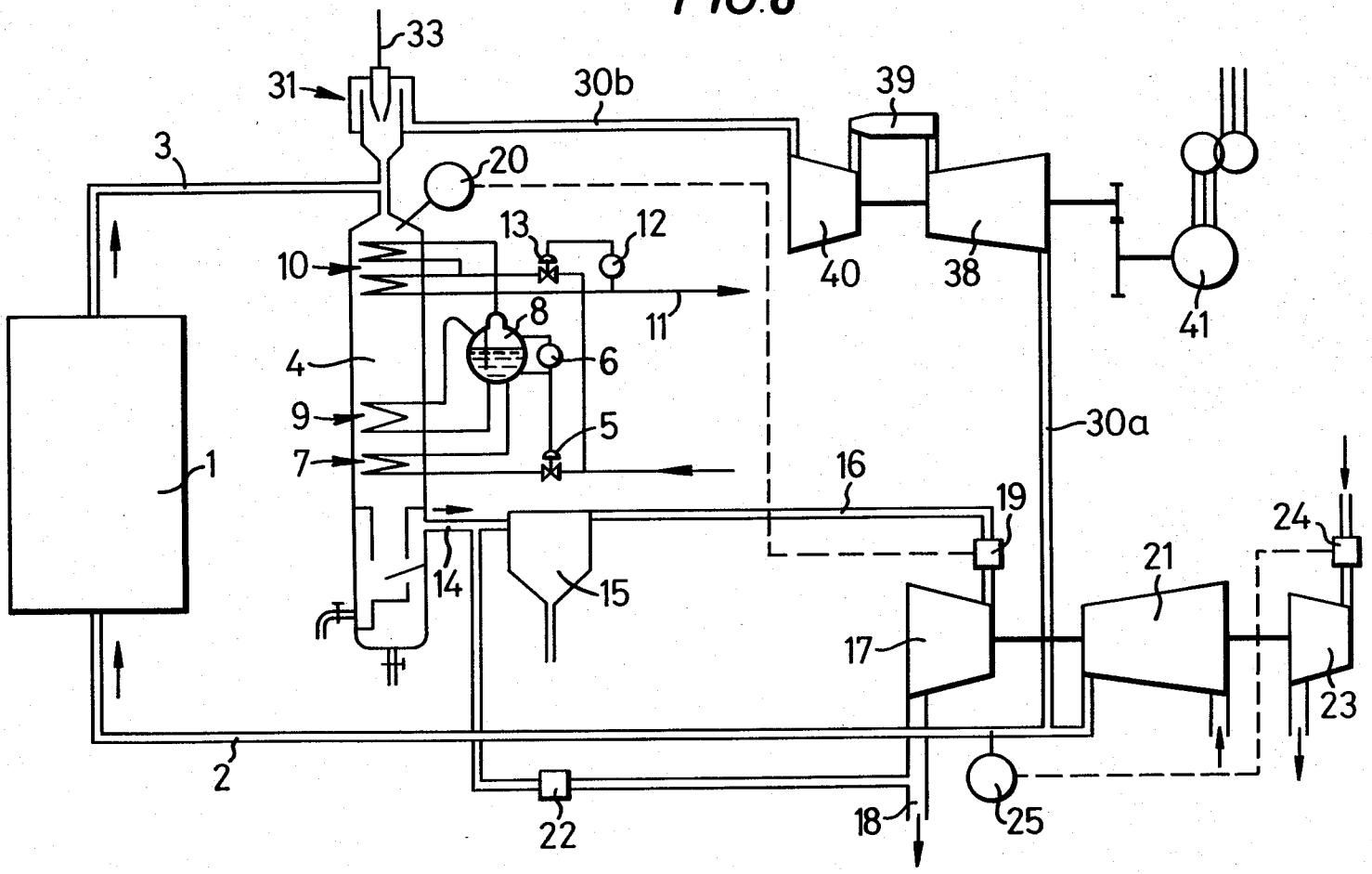
Figure 9:
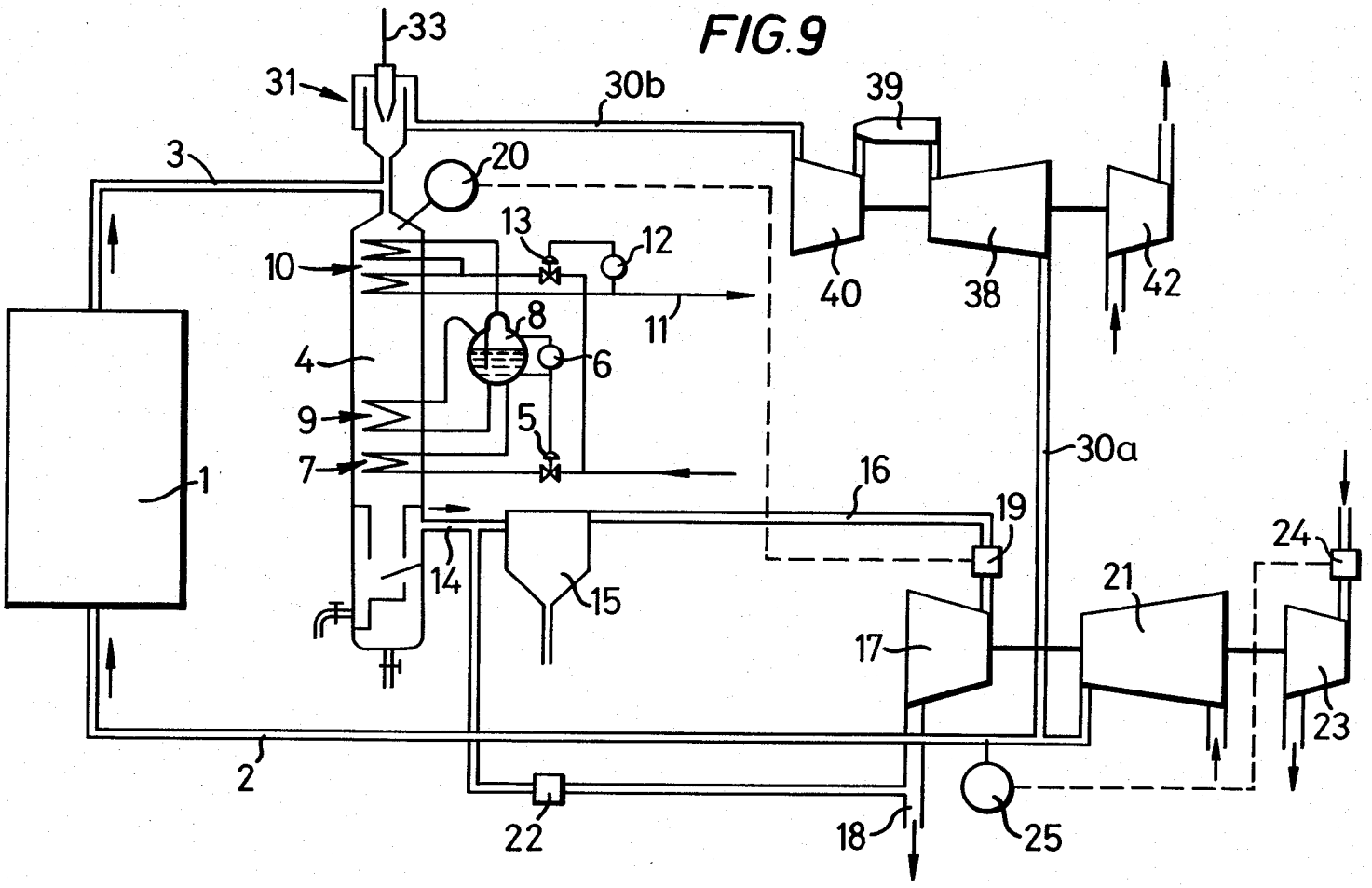

Still concerned with after-burning, if large quantities of energy are required, the variant according to FIG. 8 can be used by interposing between the two parts 30*a* and 30*b* of the preceding circuit 30 for after-burning air, a gas turbine with its compressor 38, its combustion chamber 39 and its turbine 40, the whole being adjusted to about 300% excess air. This is the conventional figure for gas turbines to achieve a suitable operating temperature. The high-temperature gases containing an excess of air are then utilised for the after-burning of the carbon monoxide to produce an effect which is of great interest from the energy point of view. The gas turbine set at 38–40 drives, for example via a reducer, an alternator 41 supplying power to the mains. Alternatively as shown in FIG. 9, this set may drive a compressor 42 directly if other gases in the plant require compression.

The turbine 17 and the compressor 21 may be mounted on two separate shafts, without altering the basis of the invention.

All temperatures are measured in degrees Centigrade.

I claim:

1. Process for extracting energy and removing solid particles from hot, dust-laden gases (3) emitted from a plant (1) simultaneously supplied with combustion air (2) under pressure characterized by the fact that (a) the hot gases (3) before being cooled or treated with water are supplied to a steam boiler (4) wherein thermal energy is extracted, (b) the solid particles are then removed in a dry manner from the cooled gases still under pressure, and (c) the solids-free and cooled gases are then fed to an expansion turbine (17) wherein mechanical energy is extracted, the supply of combustion air (2) to the plant (1) being provided by a compressor (21) driven by said expansion turbine (17), the whole being arranged so that the unit formed by the turbine and the compressor has a shortfall of energy and that the make-up is supplied by a steam turbine (23) whose inlet is regulated according to the flow (25) of the combustion air supplied.

2. Process for extracting energy and removing solid particles from hot, dust-laden gases (3) emitted from a plant (1) simultaneously supplied with combustion air (2) under pressure characterized by the fact that (a) the hot gases (3) before being cooled or treated with water are supplied to a steam boiler (4) and are circulated at a speed between 10 and 30 meters per second wherein thermal energy is extracted, (b) the solid particles are then removed in a dry manner from the cooled gases still under pressure, and (c) the solids-free and cooled gases are then fed to an expansion turbine (17) wherein mechanical energy is extracted, the supply of combustion air (2) to the plant (1) being provided by a compressor (21) driven by said expansion turbine (17), the whole being arranged so that the unit formed by the turbine and the compressor has a shortfall of energy, and that the make-up is supplied by a steam turbine (23) whose inlet is regulated according to the flow (25) of the combustion air supplied.

3. Process according to claim 5 or 6, characterised by the fact that the expansion turbine (17) is a variable inlet turbine whose inlet (19) is controlled as a function of the boiler pressure.

4. Process according to either of claims 1 or 2, characterised by the fact that a gas turbine set (38-39-40) driving an electric generator (41) or a compressor (42) is arranged on the piping (30*a*-30*b*) for the compressed air line.

* * * * *